US011511308B2

(12) United States Patent
Roetker et al.

(10) Patent No.: US 11,511,308 B2
(45) Date of Patent: Nov. 29, 2022

(54) THREAD COATING USING INKJET PRINTHEAD

(71) Applicant: Memjet Technology Limited, Dublin (IE)

(72) Inventors: Thomas Roetker, San Diego, CA (US); Jason Mark Thelander, North Ryde (AU); Mark Profaca, North Ryde (AU); Payman Hassibi, San Diego, CA (US)

(73) Assignee: Memjet Technology Limited

( * ) Notice: Subject to any disclaimer, the term of this patent is extended or adjusted under 35 U.S.C. 154(b) by 0 days.

(21) Appl. No.: 17/174,115

(22) Filed: Feb. 11, 2021

(65) Prior Publication Data

US 2021/0252548 A1 Aug. 19, 2021

Related U.S. Application Data

(60) Provisional application No. 62/976,218, filed on Feb. 13, 2020.

(51) Int. Cl.

| | |
|---|---|
| ***B05C 5/02*** | (2006.01) |
| ***B05C 11/02*** | (2006.01) |
| ***B05C 11/08*** | (2006.01) |
| ***B05C 11/10*** | (2006.01) |

(Continued)

(52) U.S. Cl.

CPC ..... *B05C 5/0241* (2013.01); *B05C 5/0245* (2013.01); *B05C 11/021* (2013.01); *B05C 11/08* (2013.01); *B05C 11/1039* (2013.01); *B05C 11/1044* (2013.01); *B05C 13/02* (2013.01); *B05C 15/00* (2013.01)

(58) Field of Classification Search

CPC ... B05C 5/0241; B05C 5/0245; B05C 11/021; B05C 11/08; B05C 5/0291; B05C 11/1039; B05C 11/1044; B05C 13/02; B05C 15/00; B41J 25/003; B41J 3/4078; D06B 11/0023; D06P 1/0096; D06P 5/30; Y10S 118/18

USPC ..... 118/325, 420

See application file for complete search history.

(56) References Cited

U.S. PATENT DOCUMENTS 2,034,008 A * 3/1936 Taylor ..... D01F 2/30 28/165
6,652,654 B1 * 11/2003 Propp ..... D06B 23/16 118/718

(Continued)

FOREIGN PATENT DOCUMENTS

| | | | |
|---|---|---|---|
| EP | 3 070 196 | A1 | 9/2016 |
| IT | 2017 0004 6089 | A1 | 11/2018 |
| JP | 2003-342867 | A | 12/2003 |

OTHER PUBLICATIONS

International Search Report and Written Opinion of the International Searching Authority dated May 10, 2021, for PCT Application No. PCT/EP2021/051088, filed on Jan. 19, 2021, 16 pages.

*Primary Examiner* — Laura Edwards
(74) *Attorney, Agent, or Firm* — Cooley LLP

(57) ABSTRACT

A method of coating threads using a printhead having rows of nozzles extending along a length of the printhead. The method includes the steps of: feeding the thread along a length of the printhead; and ejecting ink from the rows of nozzles towards the thread. Thread-coating modules and thread-coating systems make use of the method described.

4 Claims, 5 Drawing Sheets

(51) Int. Cl.
*B05C 13/02* (2006.01)
*B05C 15/00* (2006.01)

(56) References Cited

U.S. PATENT DOCUMENTS

| | | | | |
|---|---|---|---|---|
| 2003/0135931 | A1* | 7/2003 | Shaw | D06B 11/0023 8/115.6 |
| 2009/0241819 | A1 | 10/2009 | Tseng | |
| 2011/0254896 | A1 | 10/2011 | Ferrarotti et al. | |
| 2019/0100873 | A1 | 4/2019 | Eklind et al. | |

* cited by examiner

THREAD COATING USING INKJET PRINTHEAD

CROSS REFERENCE TO RELATED APPLICATIONS

This application claims priority to and the benefit of U.S. Provisional Patent Application No. 62/976,218, entitled THREAD COATING USING INKJET PRINTHEAD, filed on Feb. 13, 2020, the disclosure of which is incorporated herein by reference in its entirety for all purposes.

FIELD OF THE INVENTION

This invention relates to a method and system for coating ink onto threads. It has been developed primarily for enabling pagewide inkjet printing technology to produce colored threads.

BACKGROUND OF THE INVENTION

Inkjet printers employing Memjet® technology are commercially available for a number of different printing formats, including desktop printers, digital inkjet presses and wideformat printers. Memjet® printers typically comprise one or more stationary inkjet printhead cartridges, which are user-replaceable. For example, a desktop label printer comprises a single user-replaceable multi-colored printhead cartridge, a high-speed label printer comprises a plurality of user-replaceable monochrome printhead cartridges aligned along a media feed direction, and a wideformat printer comprises a plurality of user-replaceable printhead cartridges in a staggered overlapping arrangement so as to span across a wideformat pagewidth.

U.S. Pat. No. 10,144,232, the contents of which are incorporated herein by reference, describes a scalable, modular pagewide printing system in which multiple print modules can be arranged in a N×M two-dimensional array. Providing OEM customers with the flexibility to select the dimensions and number of printheads in an N×M array in a modular, cost-effective kit form enables access to a wider range of commercial digital printing markets that are traditionally served by offset or other printing systems.

It would be desirable to use a modular pagewide printing system for coating ink onto threads. Digital inkjet printing potentially provides a highly versatile method for coloring threads, whilst avoiding some of the drawbacks of conventional thread coloring methods (e.g. water usage).

SUMMARY OF THE INVENTION

In a first aspect, there is provided a method of coating a thread using a printhead having one or more rows of nozzles extending along a length of the printhead, the method comprising the steps of:

feeding the thread along a length of the printhead; and ejecting ink from the rows of nozzles onto the thread.

Hitherto, threads have been coated using conventional dip-coating methods, which involves custom formulation of the colorant liquid as well as extensive post-coloring washing of threads (consuming very large quantities of water in the process). The novel coating methods described herein, which make use of digital inkjet printing technology, avoid these significant drawbacks of conventional thread-coloring processes and provide a versatile method for coloring threads using sophisticated color gamuts available on-demand via digital inkjet printing methods.

Preferably, the printhead has a length of at least 100 mm, at least 150 mm or at least 200 mm. Conventionally, pagewide printheads print onto media fed transversely across the rows of nozzles. It is an advantage of the present invention that pagewide printheads are employed in an unconventional manner by feeding one or more threads lengthwise generally along the rows of nozzle extending along a longitudinal axis of the printhead. The method is particularly suitable for Memjet® printheads, whereby multiple chips are butted together in a row.

In some embodiments, the thread is rotated as it is fed longitudinally along the length of the printhead. Rotation of the thread may be used to improve uniformity of the coating process.

In other embodiments, the thread is vibrated as it is fed longitudinally along the length of the printhead. Likewise, vibration of the thread may be used to improve coating uniformity. The thread may be vibrated transversely and/or longitudinally with respect to the thread feed direction.

In some embodiments, the thread and the printhead may be angled relative to each other. For example, a longitudinal axis of the thread and a longitudinal axis of the printhead may have an angle of intersection of between 0 and 30 degrees, between 0 and 20 degrees or between 0 and 10 degrees. Such an arrangement may be useful for coating a plurality of threads simultaneously whilst ensuring similar or equal coverage of each thread.

Preferably, the printhead ejects ink into a coating chamber. The coating chamber may have a plurality of printheads associated therewith. Furthermore, the coating chamber may be adapted to provide optimal coating conditions. For example, the coating chamber may be configured to manage a cloud of ink droplets ejected from the or each printhead using at least one of:

airflow in the coating chamber;

air pressure in the coating chamber;

acoustic levitation; and an internal configuration of the coating chamber.

In some embodiments, the thread is fed longitudinally through a plurality of coating chambers. Typically, each coating chamber contains an ink cloud provided by one or more monochrome printheads supplied with ink of a same color. A plurality of coating chambers arranged in series coat the thread with a different colored ink in a predetermined amount to provide a contone coating. For example, there may be four coating chambers corresponding to CMYK inks respectively, with an ink cloud density in each chamber being digitally controlled via a printhead controller sending 'dot' data to respective printheads. In this way, the thread may be coated using full color gamuts that are available in conventional inkjet printing.

The plurality of coating chambers may be positioned in a line or, preferably, the coating chambers are laterally positioned with respect to each other such that the thread is fed in opposite longitudinal directions past sequential coating chambers or sequential sets of coating chambers.

In other embodiments, the printhead is a full color printhead such that the coating chamber generates a contone ink cloud in accordance with dot data sent to rows of CMYK nozzles.

In a second aspect, there is provided a thread-coating module comprising:

an elongate coating chamber having enclosed sidewalls, a thread entrance at one end and a thread exit at an opposite end thereof; and one or more printheads positioned for ejecting ink droplets into the coating chamber, wherein the sidewalls have one or more openings aligned with respective printheads.

The thread-coating module may advantageously be used as part of a thread-coating system comprising a plurality of such modules.

The thread-coating module may have a plurality of printheads. For example, a first printhead may be positioned at a first side of the coating chamber and a second printhead positioned at a second side of the coating chamber opposite the first side. The second printhead may be downstream of the first printhead relative to a thread feed direction.

Preferably, an exhaust opening is positioned opposite each printhead, the exhaust opening receiving ink droplets ejected into the coating chamber.

Preferably, the thread-coating module further comprises a cloud control system for controlling a cloud of ink droplets ejected from the printheads, the cloud control system comprising at least one of:

an airflow management system for controlling airflow in the coating chamber;

an air pressure management system for controlling air pressure in the coating chamber; and an acoustic device for suspending ink droplets using acoustic levitation.

In a third aspect, there is provided a thread-coating system for coating one or more threads, said system comprising:

one or more thread-coating modules as defined hereinabove; and a thread feed mechanism for feeding a thread longitudinally through each coating chamber.

The thread-coating system may comprise at least one of:

a thread gatherer upstream of a first thread-coating module, the thread gatherer being configured for gathering a plurality of threads into a thread group for feeding through a first coating chamber;

a thread expander downstream of a second thread-coating module for expanding the thread group;

a thread vibrator;

a thread rotator;

a thread flattener for flattening threads prior to drying; and a dryer for drying coated threads.

Typically, a plurality of thread-coating modules are arranged in series, each thread-coating module coating the thread with a different colored ink in a predetermined amount to provide a contone coating.

The thread-coating system may further comprise an ink recycling system for recycling ink received in each exhaust opening of a respective thread-coating module into an ink reservoir supplying ink to each printhead.

As used herein, the term "ink" is taken to mean any printing fluid, which may be printed from an inkjet printhead. Usually, the ink contains a colorant. However, the term "ink" may include conventional dye-based or pigment based inks, infrared inks, fixatives (e.g. pre-coats and finishers), functional fluids (e.g. solar inks) and the like.

As used herein, the term "pagewide printhead" refers to a printhead comprised of multiple printhead chips and typically have a length of at least 100 mm, at least 150 mm or at least 200 mm. The printhead chips may be butted together in a row or alternately staggered in an overlapping array along a length of the printhead. Pagewide printhead technology will be well known to the person skilled in the art and is synonymous with "linehead" printhead technology and "single-pass" printing technology.

BRIEF DESCRIPTION OF THE DRAWINGS

Embodiments of the present invention will now be described by way of example only with reference to the accompanying drawings, in which.

DETAILED DESCRIPTION OF THE INVENTION

Figure 1:
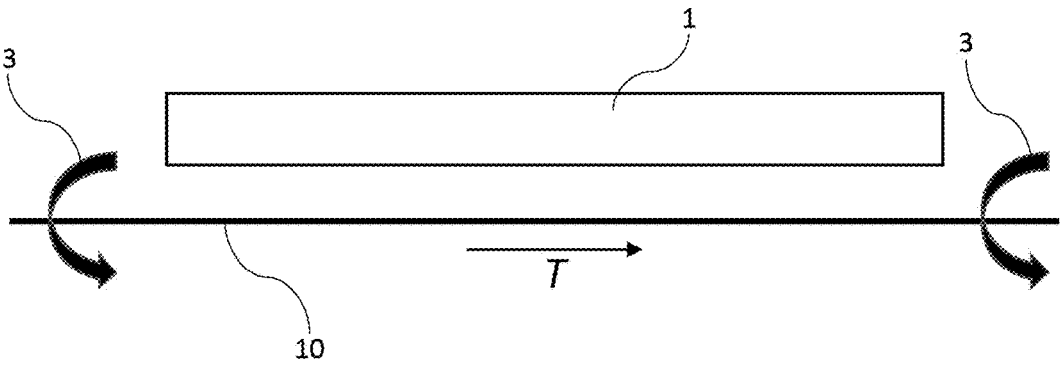
FIG. 1 is a schematic side view of a thread-coating system.

In the following description of various embodiments of the present invention, like features are given like reference numerals, where appropriate.

Referring to FIG. 1, there is shown schematically a system according to a first embodiment for coating ink onto a thread 10 using a pagewide printhead 1 having longitudinal rows of inkjet nozzles. The printhead 1 typically has a length of at least 200 mm and may be part of a print module, as described in U.S. Pat. No. 10,144,232, the contents of which are incorporated herein by reference. Maintenance systems for such print modules are also described in U.S. Pat. No. 10,144,232.

Still referring to FIG. 1, the thread 10 is fed in a direction indicated by arrow T along a long axis of the printhead 1 whilst being rotated using a thread rotator 3. Typically, print media are fed transversely past pagewide inkjet printheads across the rows of nozzles; however, pagewide printheads have hitherto not been used for coating ink onto threads longitudinally in the manner shown in FIG. 1. Memjet® printheads are suitable for use as the printhead 1 and contain a plurality of butting printhead chips defining multiple rows of nozzles extending along the length of the printhead, thereby providing excellent ink coverage of the thread 10. Rotation of the thread 10 during its traverse along the length of the printhead 1 may be used to ensure that each part of the thread is colored by ink jetted from the printhead. Alternatively or additionally, the thread 10 may be vibrated whilst being fed along the printhead 1.

Figure 2:
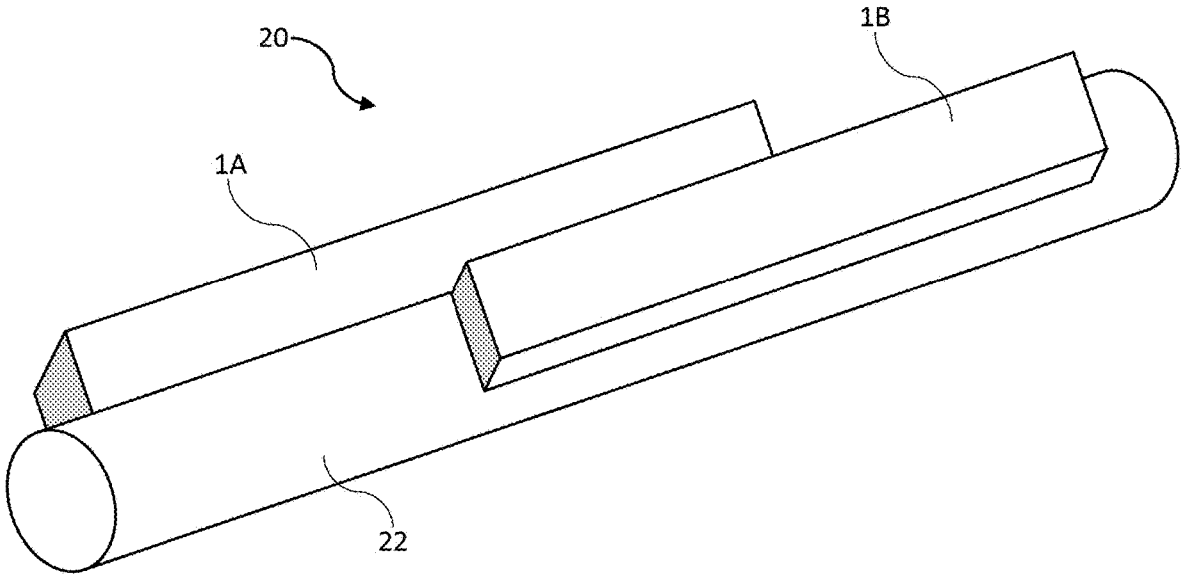
FIG. 2 is a schematic perspective of a thread-coating module according to a first embodiment.

Referring to FIG. 2, there is shown schematically a thread-coating module 20 comprising an elongate coating chamber 22 in the form of a cylindrical tube and first and second pagewide printheads 1A and 1B positioned around the coating chamber for ejecting ink droplets towards a thread (not shown in FIG. 2) fed longitudinally through the coating chamber. Each printhead is aligned with a respective slot (not shown in FIG. 2), thereby enabling the printheads to fire droplets into the coating chamber 22.

The first printhead 1A is upstream of the second printhead 1B in a staggered overlapping arrangement in order to maximize coating efficiency. It will of course be appreciated that additional printheads may be provided in the thread-coating module 20, both circumferentially to increase ink cloud density and/or lengthwise to increase an effective "coating zone".

A distance between the thread 10 and each printhead 1 may be fixed or varied and suitable mechanisms may be provided for adjusting the height of the printhead relative to the thread. In conventional media printing, inkjet printheads are positioned about 0.5 to 5 mm away from a media surface for optimal drop placement accuracy. By contrast, thread printing optimally employs a dispersed ink cloud and the 'throw distance' (that is, the distance between the thread and the printhead nozzles) is typically large compared to conventional media printing. For example, the distance between the thread and printhead nozzles may be greater than 5 mm, greater than 10 mm, greater than 20 mm, greater than 50 mm or greater than 100 mm. Accordingly, an effective ink cloud density experienced by the thread may be controlled by at least two factors: (1) a distance between the thread and the printhead; and (2) dot data supplied to the printhead. In some embodiments, the 'throw distance' may be varied by adjusting the position(s) of the printhead(s). Optimization of coating uniformity, coating density, coating speed etc. are factors that may determine the throw distance for any given coating job.

Figure 3:
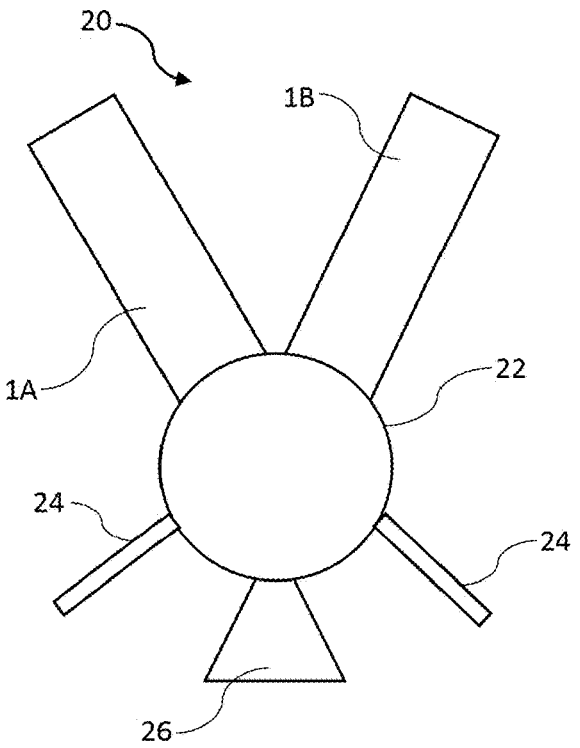
FIG. 3 is a schematic end view the thread-coating module according to the first embodiment showing airflow jets.

FIG. 3 is a schematic sectional view of the thread-coating module 20 having airflow jets 24 for controlling an ink cloud inside the coating chamber 22. It may be desirable to increase the dwell time of an ink cloud inside the coating chamber 22 by inducing vortices in therein using suitably controlled airflow jets positioned around the coating chamber. Increasing the dwell time of the ink cloud advantageously maximizes ink usage. The configuration of the coating chamber 22 may also be optimized for generating controllable vortices. For example, cross-sectional chamber profiles, such as spiral, multi-lobed, elliptical, star-shaped etc. are all within the ambit of the present invention. Additionally, a suction port 26 may be used for controlling air pressure inside the coating chamber 22 as well as removing unused ink for recycling back to an ink reservoir.

Figure 4:
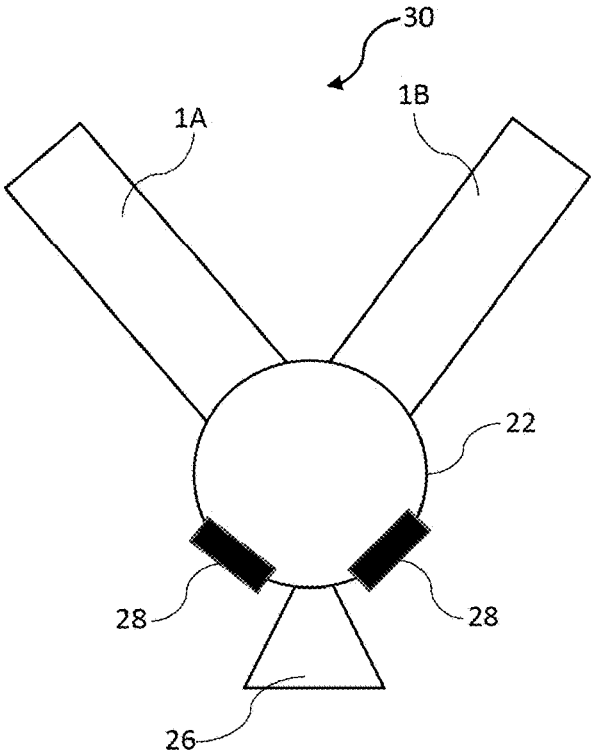
FIG. 4 is a schematic end view a thread-coating module according to a second embodiment having acoustic levitation devices.

FIG. 4 is a schematic sectional view of a thread-coating module 30 according to a second embodiment, similar to the thread-coating module 20 shown in FIG. 3. However, in the thread-coating module 30 according to the second embodiment, a plurality of acoustic devices 28 are provided for suspending ink droplets in the coating chamber 22 using acoustic levitation. Acoustic levitation may be used as an alternative to or in addition to airflow jets for controlling the ink cloud inside the coating chamber 22 and increasing the dwell time of the ink cloud.

Figure 5:
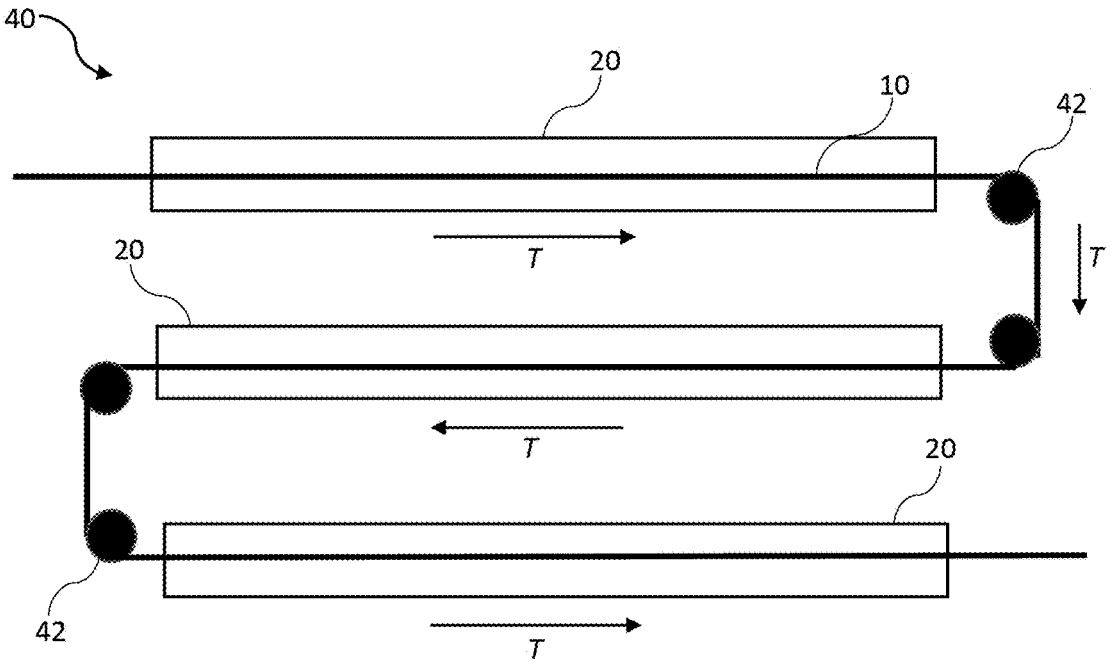
FIG. 5 is a schematic side view of a thread-coating system having multiple thread-coating modules arranged in series.

Referring to FIG. 5, there is shown a thread-coating system 40 comprising three thread-coating modules 20 arranged in series and a thread-feed assembly for feeding the thread 10 along a direction indicated by arrows T. In order to occupy minimal space, the thread-coating modules 20 are arranged laterally and the thread 10 is fed in opposite directions through sequential modules using a series of rollers 42.

Although three thread-coating modules 20 are shown in FIG. 5, it will be appreciated that any number of modules may be used in such a system. For example, multiple monochrome modules supplied with ink of the same color may be provided to increase ink coverage. Furthermore, multiple monochrome modules of different colors (e.g. CMYK) may be used to provide colored threads in any given color on demand from an available color gamut. It will be appreciated that different ink cloud densities in respective coating chambers may be used to build up a desired contone thread color in an analogous manner to contone printing using monochrome halftone images.

Figure 6:
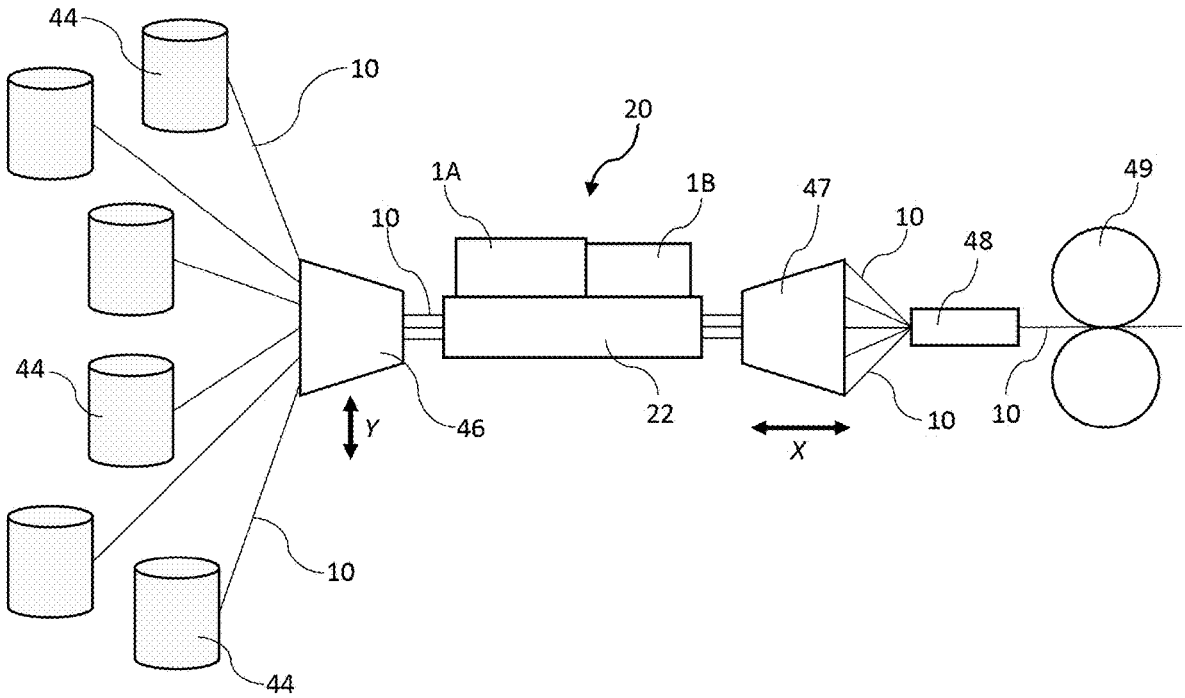
FIG. 6 is a schematic side view of a thread-coating system with pre- and post-processing of threads.

Referring to FIG. 6, there is shown a thread-coating module 20 for coating multiple threads 10 with pre- and post-processing of the threads. Six thread spools 44 continuously feed respective threads 10 into a thread gatherer 46, which arranges the threads into a 3×2 array for coating. The six threads are then fed longitudinally through the coating chamber 22 for coating simultaneously using the first and second printheads 1A and 1B. The coated threads then exit the coating chamber 22 into a thread expander 47 before being flattened into a 6×1 array in a thread flattener 48, and dried through a heated roller assembly 49. In order to optimize coating uniformity in the coating chamber 22, the thread gatherer 46 imparts a transverse vibrational force onto the threads 10 indicated by arrow Y, while the thread expander 47 imparts a longitudinal vibrational force onto the threads indicated by arrow X.

Figure 7:
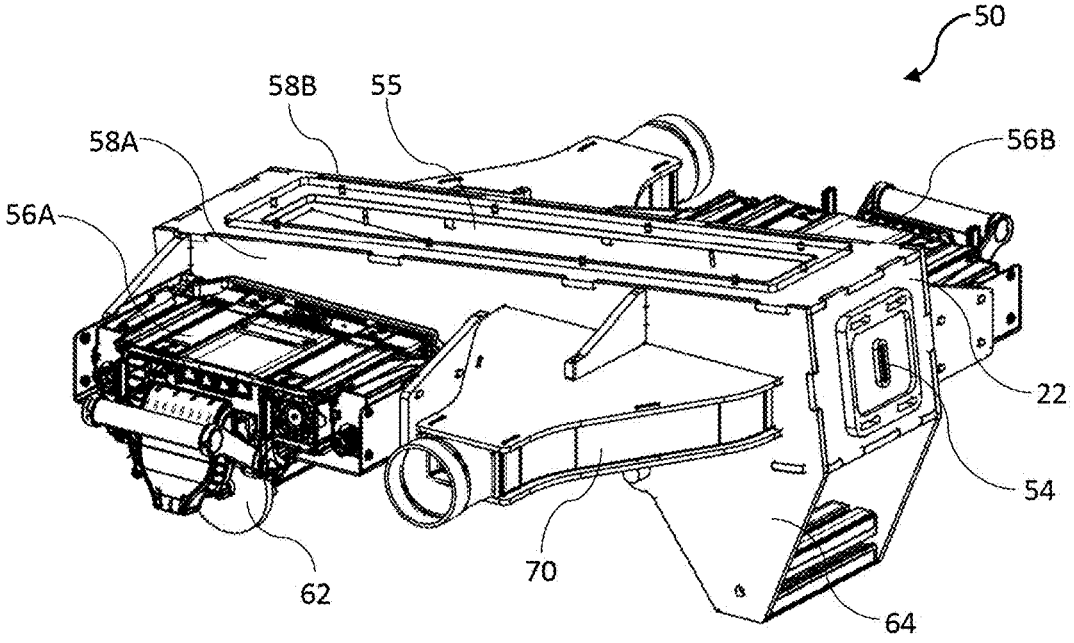
FIG. 7 is a top perspective of a thread-coating module according to a third embodiment.
Figure 8:
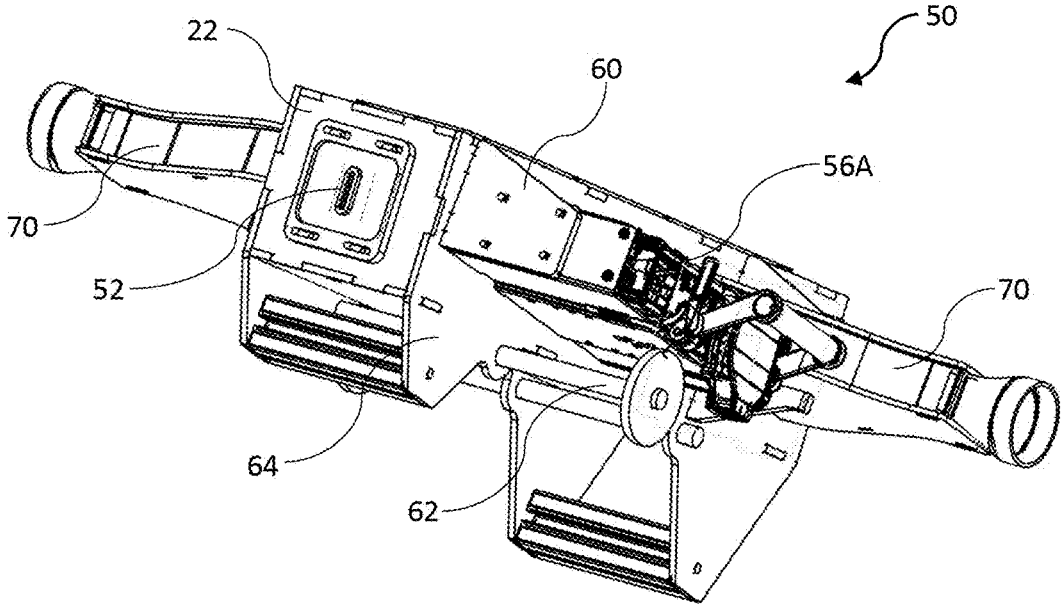
FIG. 8 is a bottom perspective of the thread-coating module shown in FIG. 7.
Figure 9:
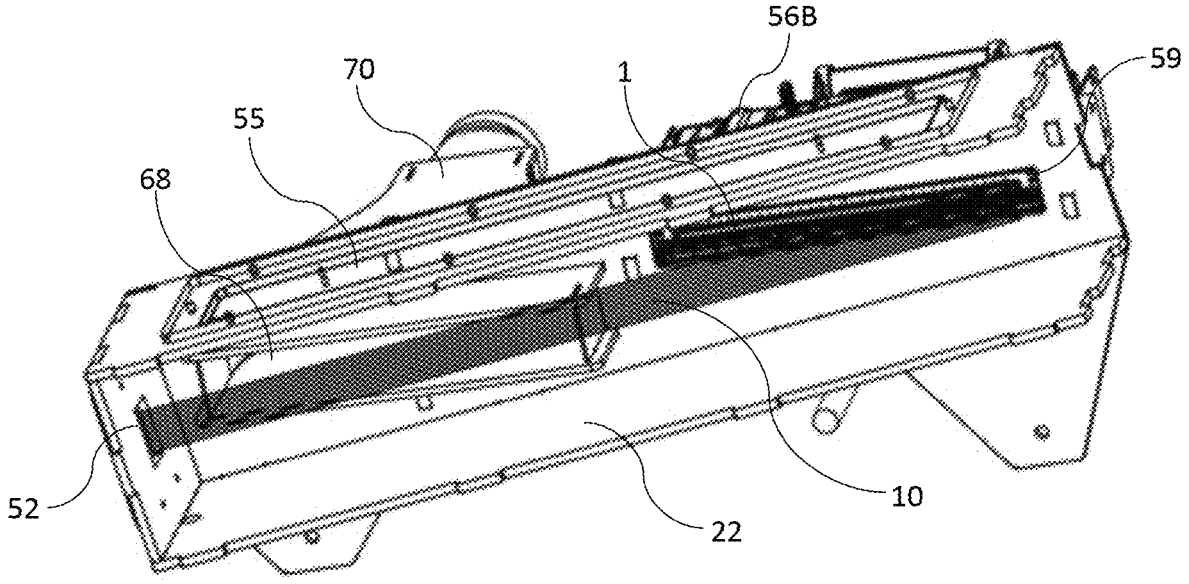
FIG. 9 is a longitudinal sectional perspective of the thread-coating module shown in FIG. 7.

FIGS. 7 to 9 show a thread-coating module 50 according to a third embodiment. In this third embodiment the elongate coating chamber 22 is generally rectangular in cross-section having a thread entrance 52 at one end, a thread exit 54 at an opposite end and a roof defining an elongate utility slot 55 enabling control of air pressure inside the coating chamber as well as maintenance/cleaning of the coating chamber when required. The thread entrance 52 is configured to receive six threads in a linear array for coating using first and second print modules 56A and 56B, although it will be appreciated that the number of threads and print modules may be varied. Each print module is of the type described in U.S. Pat. No. 10,144,232 and each comprises a respective replaceable pagewide printhead 1. The second print module 56B is positioned downstream of the first print module 56A relative to a thread feed direction. Further, the first print module 56A is mounted to a first sidewall 58A of the coating chamber 22 while the second print module 56B is mounted to an opposite second sidewall 58B thereof, such that respective printheads 1 overlap along a longitudinal axis of the coating chamber. Each sidewall defines a slot 59 enabling respective printheads 1 to eject ink droplets into the coating chamber 22 (see FIG. 9).

The first and second print modules 56A and 56B are slidably received in respective sleeves 60 fastened to the first and second sidewalls 58A and 58B, respectively, and extending outwardly therefrom. Each sleeve 60 is supported by means of a respective brace 62 extending outwardly from a support chassis 64 fastened to a lower portion of the coating chamber 22. The support chassis 64 and braces 62 provide structural rigidity to the thread-coating module 50 as well as providing a convenient means for mounting the module in a thread-coating system.

The printhead 1 of each print module 56 has an associated exhaust slot 68 defined in a respective opposite sidewall of the coating chamber 22 and aligned with a respective printhead. Each exhaust slot 68 is connected to an exhaust manifold 70, which receives ink droplets ejected into the coating chamber 22 via the exhaust slot. Suction may be applied to the exhaust manifold 70 to assist with ink extraction and recycling of ink.

As best seen in FIG. 9, the longitudinal axis of each printhead 1 is angled relative to a longitudinal axis of the coating chamber 22. This ensures coverage of all six threads, which may be wider than the combined width of the nozzle rows. Likewise, the aligned exhaust slots 68 and exhaust manifolds 70 are correspondingly angled.

Figure 10:
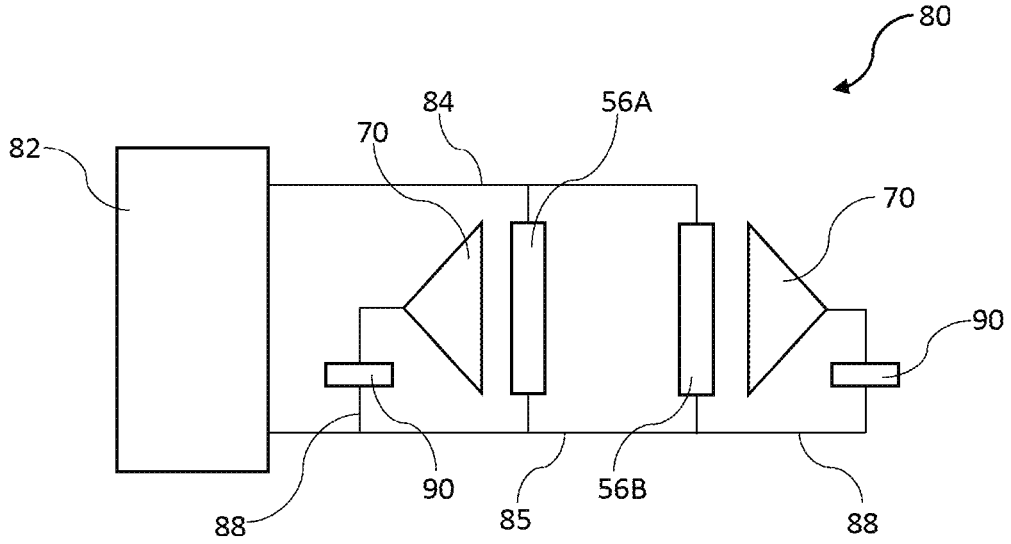
FIG. 10 is a schematic view of an ink delivery system for a plurality of monochrome thread-coating modules.

FIG. 10 shows schematically an ink delivery system 80 suitable for use with the thread-coating module 50 according to the third embodiment. An ink reservoir 82 supplies ink to both the first print module 56A and the second print module 56B via a positively pressurized supply line 84 and a negatively pressurized return line 85. To this extent, the ink delivery system 80 may be as described in U.S. Pat. No. 10,252,540, the contents of which are incorporated herein by reference. However, each exhaust manifold 70 is connected to the return line 85 via a respective exhaust line 88 having an inline filter 90. In this way, ink captured by the exhaust manifolds 70 is filtered and recycled to the ink reservoir 82 for subsequent use.

From the foregoing, it will be appreciated that pagewide inkjet coating technology is continuously expanding into new markets and can potentially revolutionize traditional thread coloring processes by improving speed, versatility and efficiency, as well as lowering costs and reducing ink and water wastage.

It will, of course, be appreciated that the present invention has been described by way of example only and that modifications of detail may be made within the scope of the invention, which is defined in the accompanying claims.

The invention claimed is:

1. A thread-coating system for coating one or more threads, said system comprising a plurality of thread-coating modules arranged in series, each thread-coating module coating the threads with a different colored ink in a predetermined amount to provide a contone coating, each thread-coating module comprising:

an elongate coating chamber having enclosed sidewalls, a thread entrance at one end and a thread exit at an opposite end thereof; and one or more printheads positioned at the sidewalls for ejecting ink droplets into the coating chamber, the sidewalls have one or more openings aligned with every printhead, wherein an exhaust opening is positioned opposite every printhead, the exhaust opening receiving ink droplets ejected into the coating chamber.

2. The thread-coating system of claim 1, wherein a longitudinal axis of each printhead is angled relative to a longitudinal axis of its respective coating chamber.

3. The thread-coating system of claim 1 further comprising at least one of:

a thread gatherer upstream of a first thread-coating module, the thread gatherer being configured for gathering a plurality of threads into a thread group for feeding through a first coating chamber;

a thread expander downstream of a second thread-coating module for expanding the thread group;

a thread vibrator; and a thread rotator.

4. The thread-coating system of claim 1, further comprising an ink recycling system for recycling ink received in every exhaust opening of a respective thread-coating module into an ink reservoir supplying ink to every printhead, said ink recycling system comprising a return line interconnecting the exhaust opening and the ink reservoir.

* * * * *